US009926093B2

(12) United States Patent
Chen

(10) Patent No.: US 9,926,093 B2
(45) Date of Patent: Mar. 27, 2018

(54) BRAKE DEVICE OF FILM PACKING DEVICE

(71) Applicant: Hsiu-Man Yu Chen, Taichung (TW)

(72) Inventor: Hsiu-Man Yu Chen, Taichung (TW)

( * ) Notice: Subject to any disclaimer, the term of this patent is extended or adjusted under 35 U.S.C. 154(b) by 222 days.

(21) Appl. No.: 14/944,930

(22) Filed: Nov. 18, 2015

(65) Prior Publication Data

US 2017/0137160 A1 May 18, 2017

(51) Int. Cl.
*B65B 67/08* (2006.01)
*B65H 23/08* (2006.01)

(52) U.S. Cl.
CPC ..... *B65B 67/085* (2013.01); *B65H 23/085* (2013.01); *B65H 2801/81* (2013.01)

(58) Field of Classification Search
CPC ..... B65B 67/085; B65H 23/085; B65H 2801/81; B65H 35/00; B65H 75/08; B65H 75/185
See application file for complete search history.

(56) References Cited

U.S. PATENT DOCUMENTS

| | | | | |
|---|---|---|---|---|
| 6,019,308 | A * | 2/2000 | Huang | B65B 67/085 242/588.2 |
| 6,227,480 | B1 * | 5/2001 | Huang | B65H 35/0026 242/588.2 |
| 7,210,649 | B2 * | 5/2007 | Yu Chen | B65D 85/02 242/405.3 |
| 7,552,891 | B2 * | 6/2009 | Huang | B65B 67/085 242/405.3 |
| 2004/0084559 | A1 * | 5/2004 | Fraser | B65B 67/085 242/422.4 |
| 2009/0050729 | A1 * | 2/2009 | Huang | B65B 67/085 242/410 |
| 2015/0166285 | A1 * | 6/2015 | Stanton | B65H 16/005 242/422 |

* cited by examiner

*Primary Examiner* — William A. Rivera
(74) *Attorney, Agent, or Firm* — Ming Chow; Sinorica, LLC

(57) ABSTRACT

A brake device of a film packing device includes a holding sleeve. The holding sleeve is provided with an elastic piece. An inner wall of the elastic piece is provided with a press portion. An end of an outer wall of the elastic piece is formed with an engaging trough. A brake block is provided in the engaging trough. A film receiving sleeve is fitted on the holding sleeve. When the press portion of the elastic piece is pushed, the brake block is pressed against the inner wall of the film receiving sleeve, enabling the film receiving sleeve to bring a brake function. When the film packing device is used for packing, this brake function provides a predetermined tension for the film.

10 Claims, 8 Drawing Sheets

BRAKE DEVICE OF FILM PACKING DEVICE

BACKGROUND OF THE INVENTION

1. Field of the Invention

The present invention relates to a film packing device, and more particularly to a brake device of a film packing device.

2. Description of the Prior Art

In the industrial packing operation, a roll of film is used to pack products. For the packing operation to be more smooth and convenient, the operator generally uses a film packing device mounted with a roll of film to pack products.

FIG. 1 is an exploded view of a conventional film packing device. The conventional film packing device comprises a holding sleeve 1. The holding sleeve 1 is provided with an elastic piece 2. A film receiving sleeve 3 is fitted on the holding sleeve 1. The film receiving sleeve 3 is adapted to receive a roll of film.

When the film is used to pack products, it is necessary to make the film generate a certain tension so that the film can pack the products tightly. In view of this, when the film packing device is used, the operator pushes the elastic piece 2 to press against the inner wall of the film receiving sleeve 3 to provide a resistance for the film receiving sleeve 3, enabling the film to generate a tension.

However, the resistance provided by the film packing device is not enough, so the tension of the film is also limited. Through the film packing device to pack products, the film is unable to achieve the required tension. As a result, the film packing device cannot conform to the demand of the packing operation.

Accordingly, the inventor of the present invention has devoted himself based on his many years of practical experiences to solve these problems.

SUMMARY OF THE INVENTION

The present invention is to provide a brake device of a film packing device. When in use, the film packing device provides a resistance to bring a brake function. This brake function provides a predetermined tension for the film.

In order to achieve the aforesaid object, the brake device of the film packing device of the present invention comprises a holding sleeve, a brake block, and a film receiving sleeve. The holding sleeve has a cylindrical body. One end of the cylindrical body is radially provided with a retaining portion. The cylindrical body of the holding sleeve is provided with an elastic piece. An outer wall of the elastic piece is formed with an engaging trough. An inner wall of the elastic piece is provided with a press portion. Another end of the cylindrical body is provided with at least one limit member. The brake block is disposed in the engaging trough. The film receiving sleeve is fitted on the cylindrical body of the holding sleeve. The film receiving sleeve is rotatable. One end of the film receiving sleeve is radially provided with a flange. The flange leans against the retaining portion. Another end of the film receiving sleeve leans against the limit member. The film receiving sleeve is confined between the retaining portion and the limit member to turn.

When the press portion of the elastic piece is pushed, the brake block is pressed against an inner wall of the film receiving sleeve, enabling the film receiving sleeve to bring a brake function. When the film packing device is used for packing, this brake function provides a predetermined tension for the film.

DETAILED DESCRIPTION OF THE PREFERRED EMBODIMENTS

Embodiments of the present invention will now be described, by way of example only, with reference to the accompanying drawings.

Figure 1:
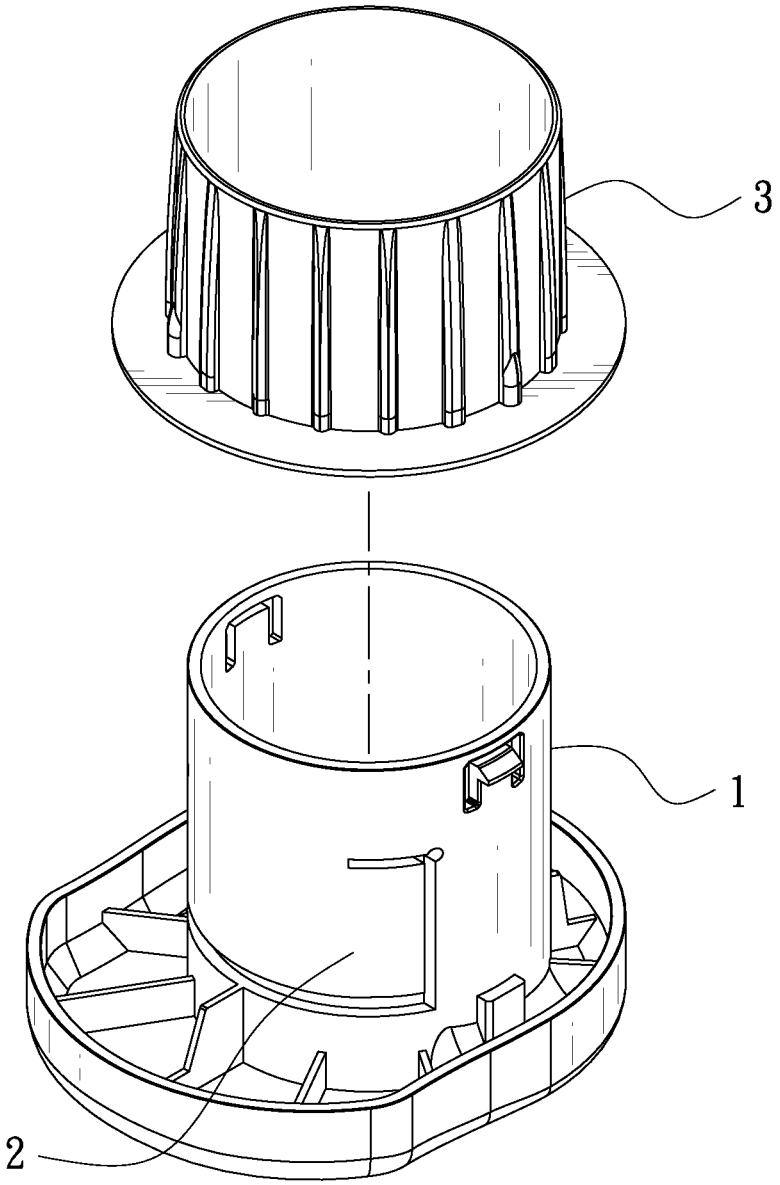
FIG. 1 PRIOR ART
FIG. 1 is an exploded view of a conventional film packing device.
Figure 2:
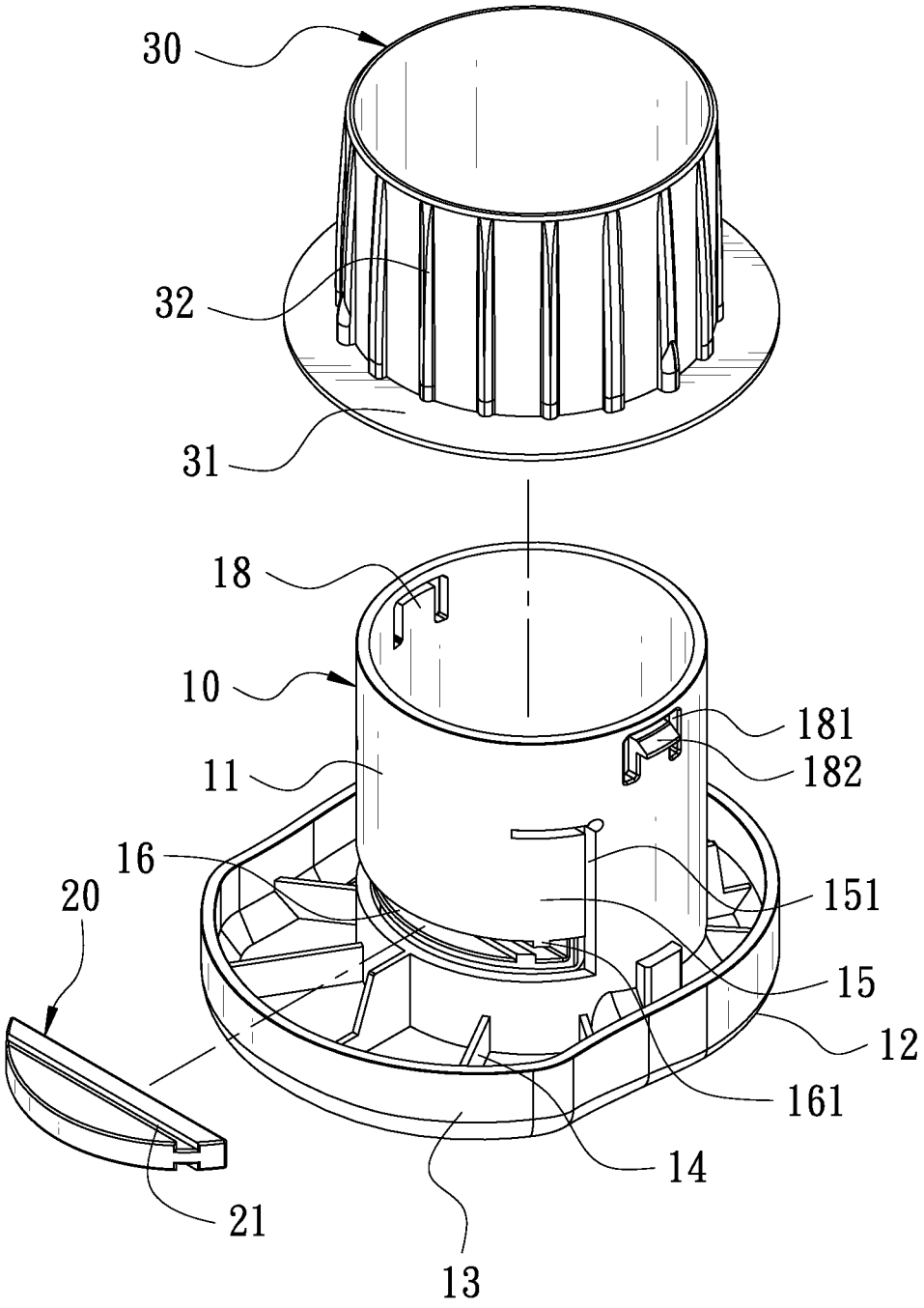
FIG. 2 is an exploded view of the present invention.
Figure 3:
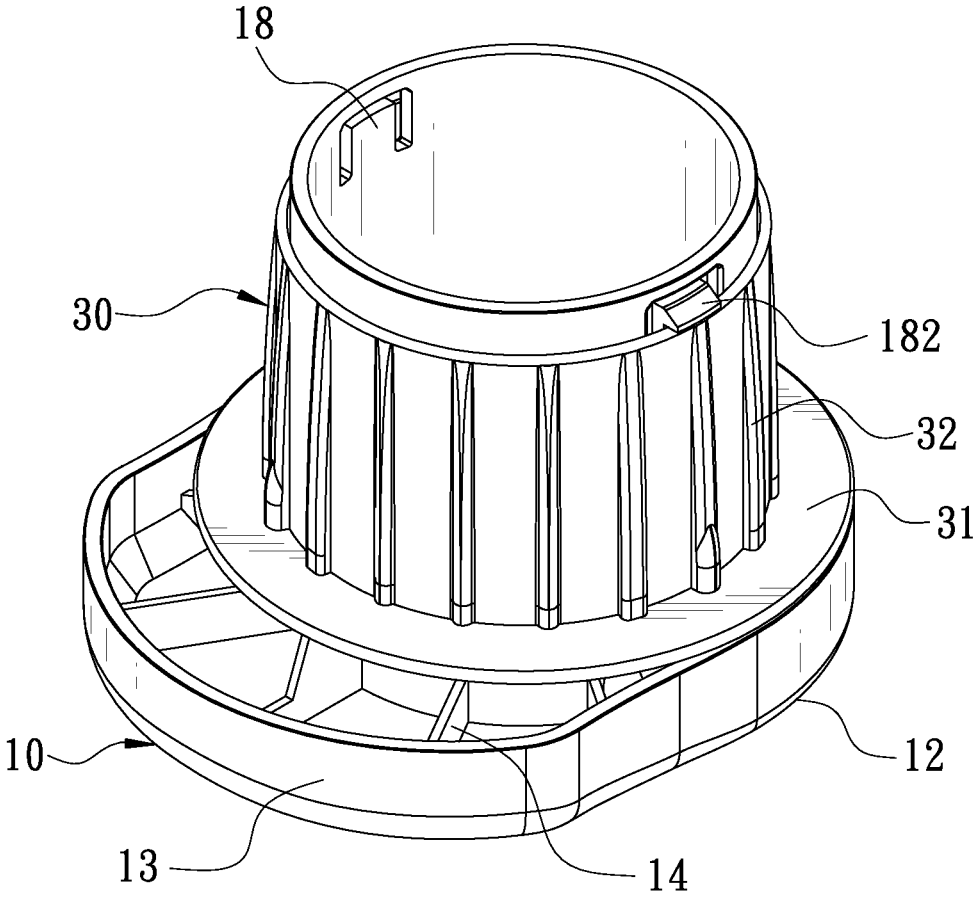
FIG. 3 is a perspective view of the present invention.
Figure 4:
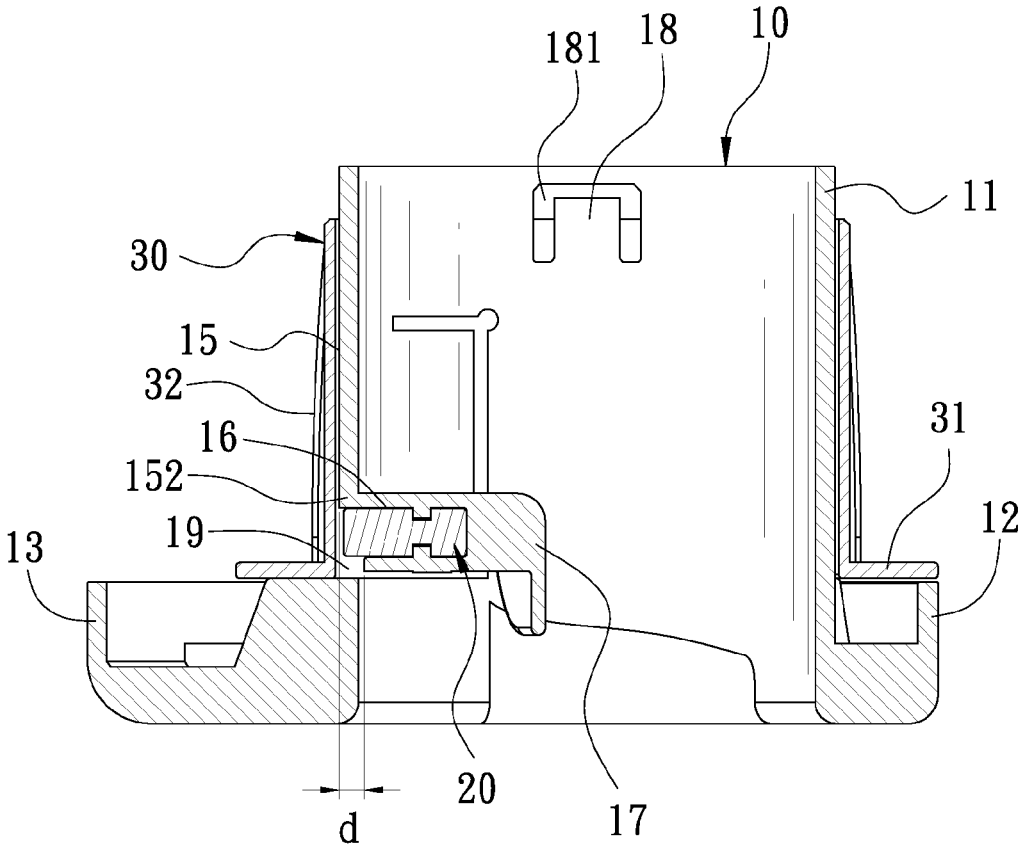
FIG. 4 is a longitudinal sectional view of the present invention.
Figure 5:
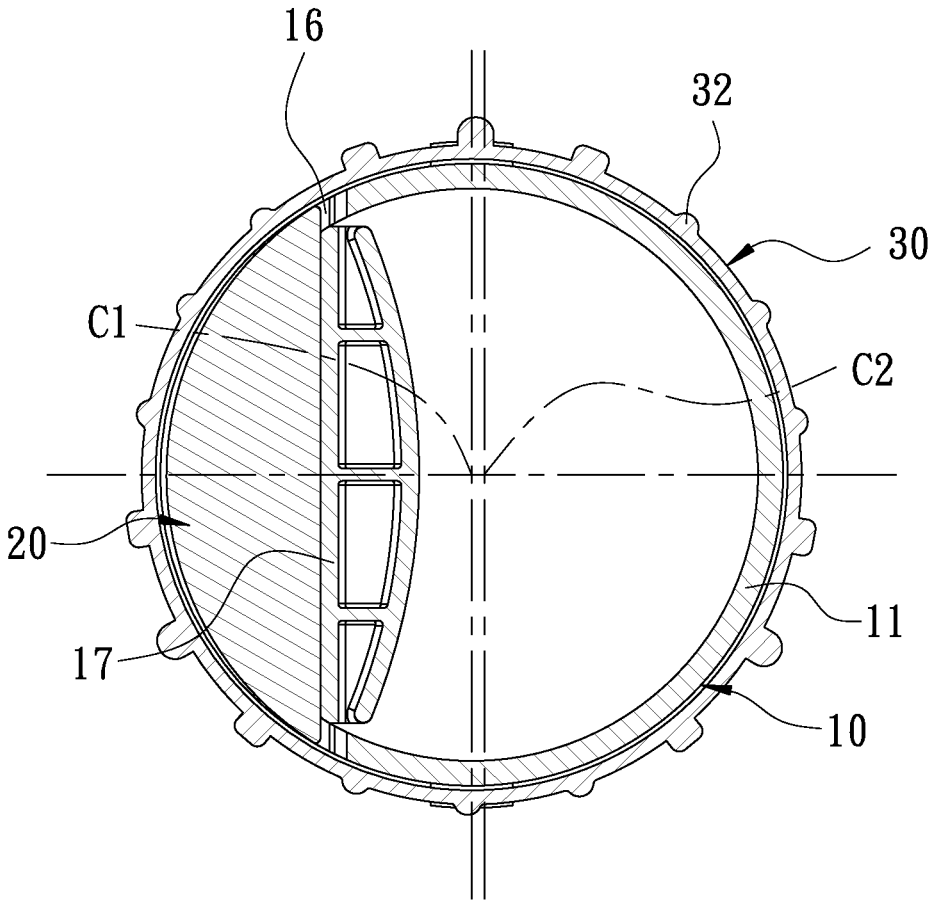
FIG. 5 is a transverse sectional view of the present invention.

FIG. 2 is an exploded view of the present invention. FIG. 3 is a perspective view of the present invention. FIG. 4 is a longitudinal sectional view of the present invention. FIG. 5 is a transverse sectional view of the present invention. The present invention discloses a brake device of a film packing device. The brake device of the film packing device comprises a holding sleeve 10, a brake block 20, and a film receiving sleeve 30.

The holding sleeve 10 has a cylindrical body 11 with a circle center C1 defined therein. One end of the cylindrical body 11 is radially provided with a retaining portion 12. One side of the retaining portion 12 is formed with a curved surface 13. The curved surface 13 is parallel to an outer wall of the cylindrical body 11. The retaining portion 12 is provided with a plurality of reinforcement ribs 14 radially disposed between the curved surface 13 and the cylindrical body 11. The cylindrical body 11 of the holding sleeve 10 is provided with an elastic piece 15. The cylindrical body 11 is formed with a U-shaped groove 151 at an outer side of the elastic piece 15, enabling the elastic piece 15 to form an elastic end 152. An outer wall of the elastic end 152 is formed with a stepped trough 19. An interval d is defined between the stepped trough 19 and the outer wall of the cylindrical body 11. The stepped trough 19 is provided with an engaging trough 16. The engaging trough 16 is further provided with a transverse engaging protrusion 161. An inner wall of the elastic end 152 of the elastic piece 15 is provided with a protruding press portion 17. Another end of the cylindrical body 11 is provided with at least one limit member 18. The limit member 18 comprises an engaging hook 182. An outer wall of the engaging hook 182 is formed with a U-shaped groove 181.

The brake block 20 is made of rubber or other materials with high friction. The brake block 20 is substantially in the shape of a segment of a circle. The brake block 20 has a transverse engaging recess 21 corresponding to the engaging protrusion 161. The brake block 20 is disposed in the engaging trough 16. An outer wall of the brake block 20 is a curved surface. A circle center C2 is defined by the curved surface. The outer wall of the brake block 20 and the outer wall of the cylindrical body 11 are disposed eccentrically. The radius of curvature of the outer wall of the brake block 20 is slightly greater the radius of curvature of the outer wall of the cylindrical body 11. When the brake block 20 is disposed in the engaging trough 16, the outer wall of the brake block 20 is gradually reduced from two ends toward the center thereof.

The film receiving sleeve 30 is fitted on the cylindrical body 11 of the holding sleeve 10 and rotatable freely. One end of the film receiving sleeve 30 is radially provided with a flange 31. The flange 31 leans against the retaining portion 12. Another end of the film receiving sleeve 30 leans against the limit member 18. The film receiving sleeve 30 is confined between the retaining portion 12 and the limit member 18 to turn freely. An outer wall of the film receiving sleeve 30 is axially provided with a plurality of spaced ribs 32.

Figure 6:
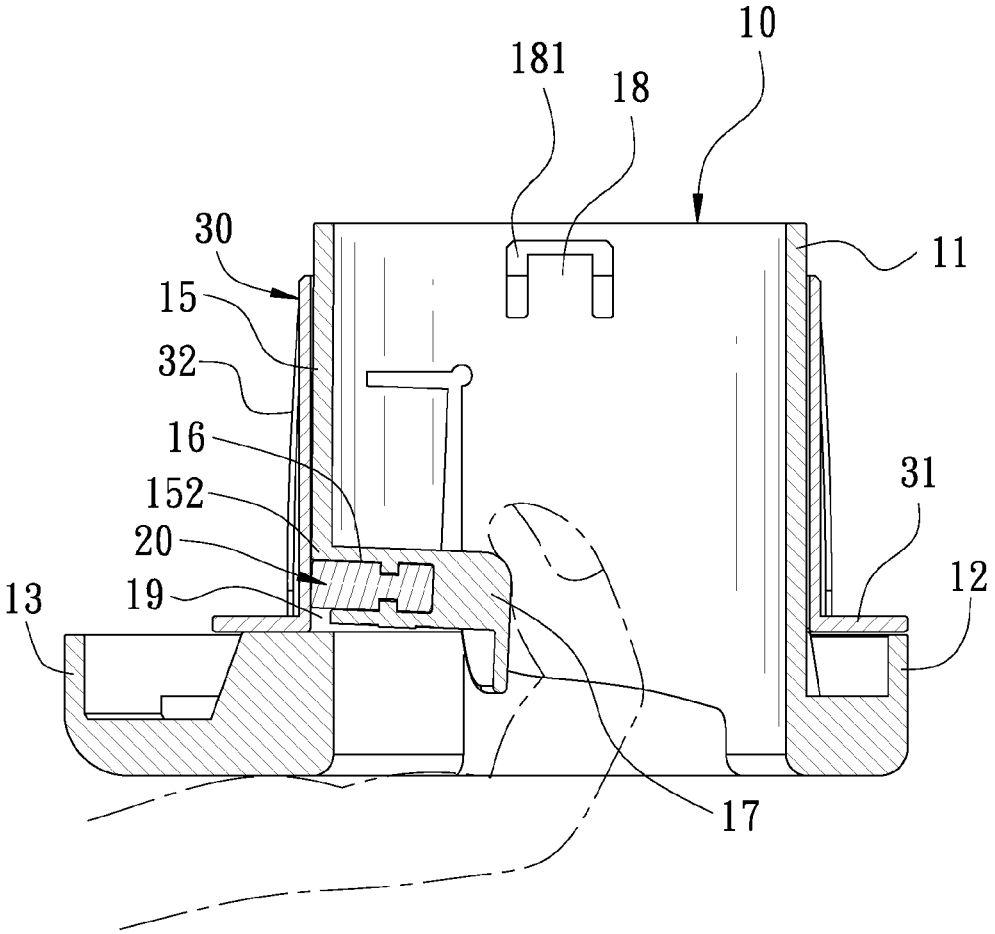
FIG. 6 is a schematic view of the present invention when in use, showing that the brake block is held.
Figure 7:
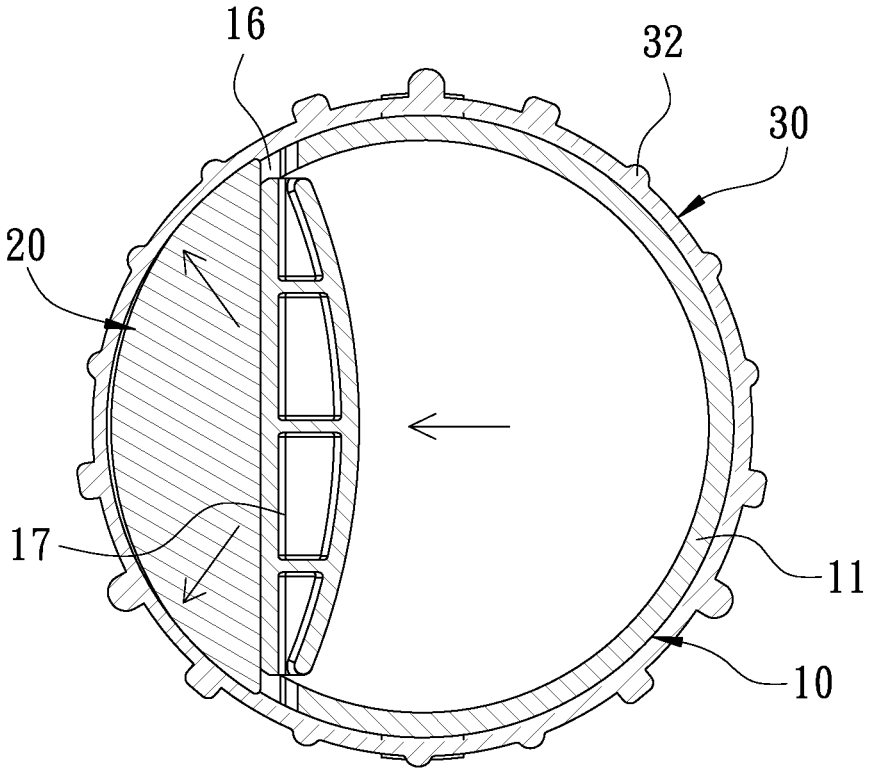
FIG. 7 is a schematic view of the present invention when in use, showing the brake block in a brake state.
Figure 8:
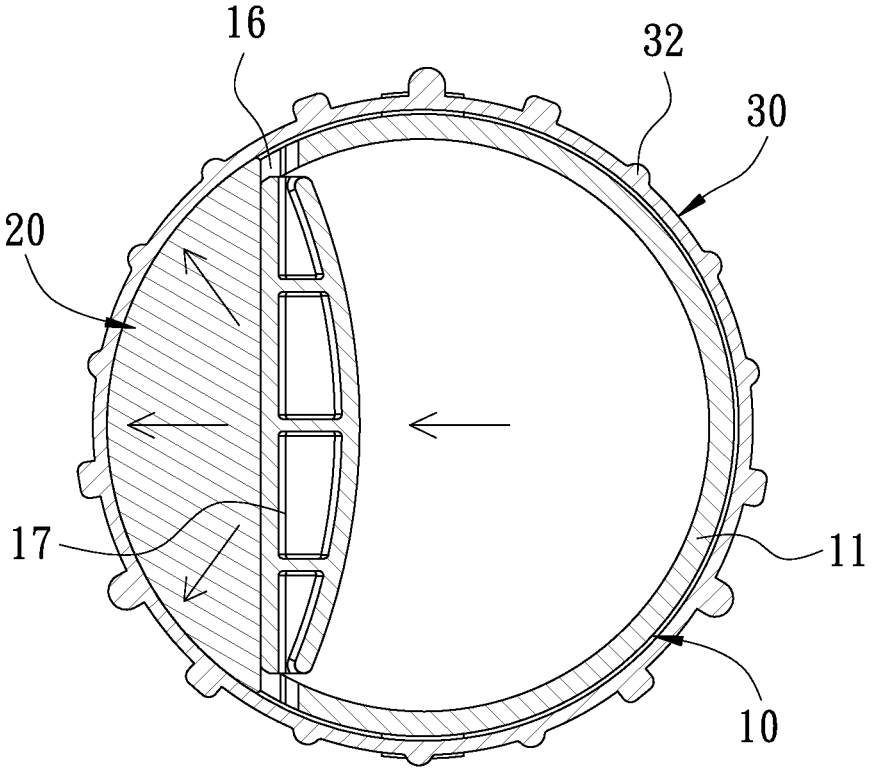
FIG. 8 is another schematic view of the present invention when in use, showing the brake block in a brake state.

FIG. 6, FIG. 7 and FIG. 8 are schematic views of the present invention when in use. The film packing device is mounted with a reel of film. When the user holds the film packing device, the user's palm holds the bottom of the retaining portion 12 and the curved surface 13, and the user's finger extends into the cylinder body 11 to slightly touch the press portion 17 so as to hold the film packing device steady. At this time, the film receiving sleeve 30 is rotatable freely on the cylindrical body 11 of the holding sleeve 10 for the film mounted on the film receiving sleeve 30 to be pulled for use.

When the user wants the film to generate a tension for packing products tightly, the press portion 17 of the elastic piece 15 is pushed by the user to push the elastic end 152 of the elastic piece 15 outwardly. The brake block 20 is pressed against the inner wall of the film receiving sleeve 30, such that the brake block 20 provides a friction resistance for the film receiving sleeve 30, enabling the film receiving sleeve 30 to bring a brake function. This brake function provides a tension for the film.

It is noted that the interval d is formed between the stepped trough 19 and the outer wall of the cylindrical body 11. When the brake block 20 is disposed in the engaging trough 16, one side of the brake block 20, leaning against the outer wall of the cylindrical body 11, is exposed out of the interval d of the stepped trough 19. When the brake block 20 is pressed against the inner wall of the film receiving sleeve 30, the exposed portion of the brake block 20 directly applies a force to the inner wall of the film receiving sleeve 30 to provide a better brake effect. After a period of use, the brake block 20 may be worn. The exposed portion of the brake block 20 is still able to apply a force to the inner wall of the film receiving sleeve 30. In normal use, the brake block provides a better brake effect.

In addition, the outer wall of the brake block 20 and the outer wall of the cylindrical body 11 are disposed eccentrically. The outer wall of the brake block 20 is gradually reduced from two ends toward the center thereof. Thus, when the press portion 17 of the elastic piece 15 is pushed by the user, the two ends of the brake block 20 are first to press against the inner wall of the film receiving sleeve 30. Afterward, the press portion 17 of the elastic piece 15 is continuously pushed, and the center portion of the brake block 20 is to press against the inner wall of the film receiving sleeve 30 to provide much friction resistance, enabling the film receiving sleeve 30 to generate a better brake function. Accordingly, the user can adjust the force to push the push portion 17 so as to adjust the contact area of the brake block 20 to press against the film receiving sleeve 30. As a result, the friction resistance between the brake block 20 and the film receiving sleeve 30 can be adjusted for the user to adjust the brake effect through the film receiving sleeve 30 so as to adjust the tension of the film.

It is noted that when the film packing film is braked, the two ends of the brake block 20 are first to press against the inner wall of the film receiving sleeve 30, and then the center portion of the brake block 20 is to press against the inner wall of the film receiving sleeve 30. When in use, this way to brake step by step can avoid the film from touching the brake block 20 to cause that the film receiving sleeve 30 is fully braked and the roll of film is unable to turn.

When the user releases the press portion 17 of the elastic piece 15, the elastic end 152 of the elastic piece 15 is returned and the brake block 20 disengages from the inner wall of the film receiving sleeve 30. At this time, the film receiving sleeve 30 can be turned freely on the cylindrical body 11 of the holding sleeve 10 for the use of the film mounted on the film receiving sleeve 30.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A brake device of a film packing device, comprising:

a holding sleeve having a cylindrical body, one end of the cylindrical body being radially provided with a retaining portion, the cylindrical body of the holding sleeve being provided with an elastic piece, an outer wall of the elastic piece being formed with an engaging trough, an inner wall of the elastic piece being provided with a press portion, another end of the cylindrical body being provided with at least one limit member;

a brake block disposed in the engaging trough; and a film receiving sleeve fitted on the cylindrical body of the holding sleeve, the film receiving sleeve being rotatable, one end of the film receiving sleeve being radially provided with a flange, the flange leaning against the retaining portion, another end of the film receiving sleeve leaning against the limit member, the film receiving sleeve being confined between the retaining portion and the limit member to turn;

wherein when the press portion of the elastic piece is pushed, the brake block is pressed against an inner wall of the film receiving sleeve, enabling the film receiving sleeve to generate a brake function.

2. The brake device of a film packing device as claimed in claim 1, wherein the cylindrical body of the holding sleeve has a circle center defined therein, the brake block is in the shape of a segment of a circle, an outer wall of the brake block is a curved surface, a circle center is defined by the curved surface, and the outer wall of the brake block and an outer wall of the cylindrical body are disposed eccentrically.

3. The brake device of a film packing device as claimed in claim 2, wherein a radius of curvature of the outer wall of the brake block is greater a radius of curvature of the outer wall of the cylindrical body, when the brake block is disposed in the engaging trough, the outer wall of the brake block is gradually reduced from two ends toward a center thereof.

4. The brake device of a film packing device as claimed in claim 1, wherein the outer wall of the elastic piece is formed with a stepped trough, a space is formed between the stepped trough and an outer wall of the cylindrical body, and the engaging trough is disposed in the stepped trough.

5. The brake device of a film packing device as claimed in claim 1, wherein the cylindrical body is formed with a U-shaped groove at an outer side of the elastic piece, enabling the elastic piece to form an elastic end.

6. The brake device of a film packing device as claimed in claim 5, wherein the press portion is disposed at the elastic end of the elastic piece.

7. The brake device of a film packing device as claimed in claim 1, wherein the limit member comprises an engaging hook, and an outer wall of the engaging hook is formed with a U-shaped groove.

8. The brake device of a film packing device as claimed in claim 1, wherein the retaining portion is provided with a plurality of reinforcement ribs radially disposed between a curved surface of the retaining portion and the cylindrical body.

9. The brake device of a film packing device as claimed in claim 1, wherein an outer wall of the film receiving sleeve is axially provided with a plurality of spaced ribs.

10. The brake device of a film packing device as claimed in claim 1, wherein the engaging trough is provided with a transverse engaging protrusion, and the brake block has a transverse engaging recess corresponding to the engaging protrusion.

* * * * *